United States Patent [19]

Munson et al.

[11] Patent Number: 4,684,952

[45] Date of Patent: Aug. 4, 1987

[54] MICROSTRIP REFLECTARRAY FOR SATELLITE COMMUNICATION AND RADAR CROSS-SECTION ENHANCEMENT OR REDUCTION

[75] Inventors: Robert E. Munson; Hussain A. Haddad; John W. Hanlen, all of Boulder, Colo.

[73] Assignee: Ball Corporation, Muncie, Ind.

[21] Appl. No.: 423,307

[22] Filed: Sep. 24, 1982

[51] Int. Cl.[4] ..... H01Q 1/38

[52] U.S. Cl. ..... 343/700 MS; 343/754; 342/368

[58] Field of Search ..... 343/700 MS, 754, 368, 343/781 R, 781 P, 818, 837, 912, 913

[56] References Cited

U.S. PATENT DOCUMENTS

| | | | |
|---|---|---|---|
| Re. 29,296 | 7/1977 | Krutsinger et al. | 343/700 MS |
| Re. 29,911 | 2/1979 | Munson | 343/700 MS |
| 3,408,653 | 10/1968 | Blass | 343/754 |
| 3,713,162 | 1/1973 | Munson et al. | 343/705 |
| 3,810,183 | 5/1974 | Krutsinger et al. | 343/708 |
| 3,811,128 | 5/1974 | Munson | 343/787 |
| 3,921,177 | 11/1975 | Munson | 343/846 |
| 3,938,161 | 2/1976 | Sanford | 343/829 |
| 3,971,032 | 7/1976 | Munson et al. | 343/770 |
| 4,012,741 | 3/1977 | Johnson | 343/700 MS |
| 4,051,477 | 9/1977 | Murphy et al. | 343/700 MS |
| 4,070,676 | 1/1978 | Sanford | 343/700 MS |
| 4,079,268 | 3/1978 | Fletcher et al. | 343/700 MS X |
| 4,110,751 | 8/1978 | Reggia et al. | 343/700 MS |
| 4,131,894 | 12/1978 | Schiavone | 343/700 MS |
| 4,180,817 | 12/1979 | Sanford | 343/700 MS |
| 4,220,956 | 9/1980 | Sanford | 343/706 |
| 4,233,607 | 11/1980 | Sanford et al. | 343/700 MS |
| 4,259,670 | 3/1981 | Schiavone | 343/700 MS |
| 4,287,518 | 9/1981 | Ellis, Jr. | 343/700 MS |
| 4,320,401 | 3/1982 | Schiavone | 343/700 MS |
| 4,320,404 | 3/1982 | Chekroun | 343/754 X |
| 4,358,771 | 11/1982 | Hsieh | 343/754 X |
| 4,445,121 | 4/1984 | Hancock et al. | 343/700 MS |

OTHER PUBLICATIONS

M. I. Skolnik, "Introduction to Radar Systems", McGraw-Hill, 1980, pp. 308-309.

M. I. Skolnik, "Radar Handbook", Chapter II, *Array Antennas,* by Theodore C. Cheston and Joe Frank, McGraw-Hill, 1970, pp. 11-54 through 11-60.

G. T. Ruck, D. E. Barrick, W. D. Stuart and C. K. Krichbaum, "Radar Cross-Section Handbook", vols. 1 and 2, Plenum Press, New York, 1970, pp. 585-670.

H. Jasik, "Antenna Engineering Handbook", Chapter 13, by W. C. Jakes and S. D. Robertson, McGraw-Hill, 1961, pp. 13-1 through 13-14.

*Primary Examiner*—Theodore M. Blum
*Assistant Examiner*—John B. Sotomayor
*Attorney, Agent, or Firm*—Gilbert E. Alberding

[57] ABSTRACT

A passive array of resonantly-dimensioned microstrip antenna radiator patches are closely spaced (i.e., less than one-tenth wavelength) above a ground plane and individually associated with transmission line segments terminated so as to cause the overall array to receive an incident r.f. electromagnetic field, to convert the received field into r.f. electrical currents which flow along the transmission lines and are absorbed by the terminations or reflected therefrom. In the latter case, the reflected r.f. energy is re-transmitted in a predetermined direction as a re-directed r.f. electromagnetic field. The presently preferred embodiment is a relatively thin, flexible and thus conformable layered structure formed by selectively etching conductive material from one side of a metallically cladded dielectric sheet. For satellite communication, a flat reflectarray may be associated with a primary r.f. transmitter/receiver structure disposed at a focal area or spot of the reflectarray having an appropriately phased aperture (e.g., parabolic). For radar cross-section enhancement or reduction, the reflectarray aperture is phased so as to retro-reflect incident r.f. fields or so as to scatter, otherwise misdirect or absorb (e.g., by using lossy resistive transmission line terminations) the incident r.f. field.

38 Claims, 13 Drawing Figures

FIG. 8
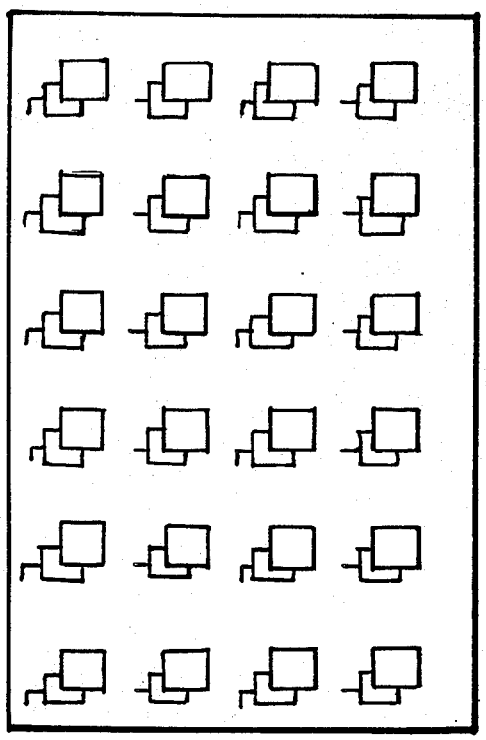
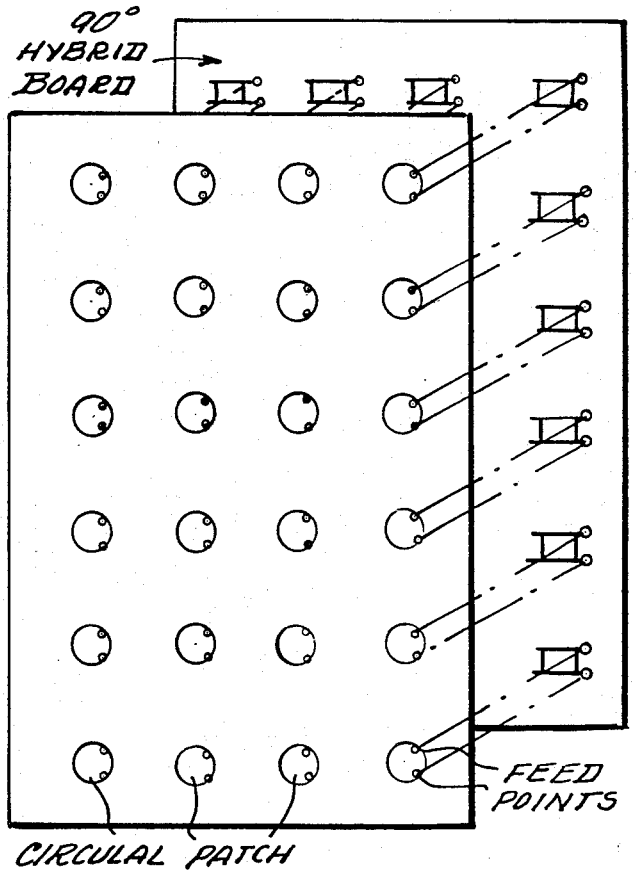
FIG. 10
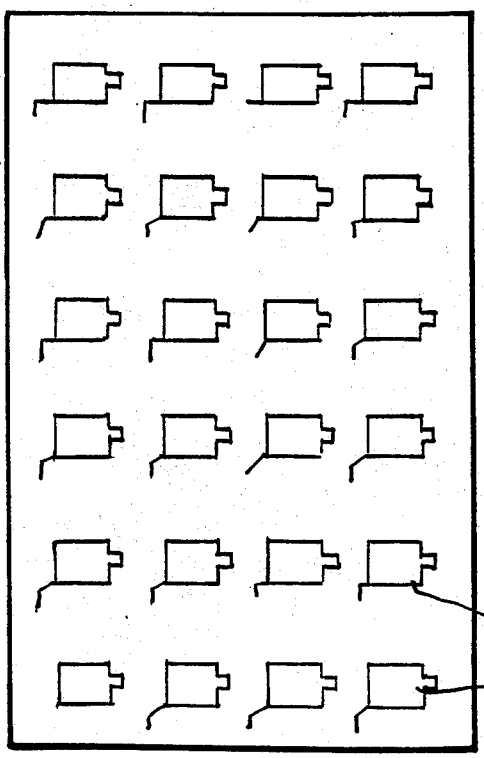
FIG. 9

MICROSTRIP REFLECTARRAY FOR SATELLITE COMMUNICATION AND RADAR CROSS-SECTION ENHANCEMENT OR REDUCTION

This invention is directed generally to antenna structures for receiving/transmitting r.f. electromagnetic fields. More particularly, it is directed to a "reflectarray" organization of microstrip antenna radiator elements of the type that are typically disposed less than one-tenth wavelength above a ground or reference conductor so as to define a resonant cavity between each such radiator element and the underlying ground surface while at the same time also defining at least one radiation slot between an edge of the radiator element and the underlying ground plane surface for coupling r.f. energy to/from the element at an intended antenna operating frequency. Typically, such microstrip antenna radiator elements or "patches" are formed by selective photo-chemical etching of a metallically cladded surface on a dielectric layer so as to produce essentially two-dimensional conductive areas where at least one of those dimensions is resonant (within the dielectric layer) at the intended antenna operating frequency.

Microstrip antenna radiator elements or "patches" per se and/or various arrays of such elements are by now well known in the art. For example, some typical prior art microstrip antenna structures are disclosed in the following prior issued U.S. patents:

U.S. Pat. No. 3,713,162—Munson et al (1973)
U.S. Pat. No. 3,810,183—Krutsinger et al (1974)
U.S. Pat. No. 3,811,128—Munson (1974)
U.S. Pat. No. 3,921,177—Munson (1975)
U.S. Pat. No. 3,938,161—Sanford (1976)
U.S. Pat. No. 3,971,032—Munson et al (1976)
U.S. Pat. No. Re. 29,296—Krutsinger et al (1977)
U.S. Pat. No. 4,012,741—Johnson (1977)
U.S. Pat. No. 4,051,477—Murphy et al (1977)
U.S. Pat. No. 4,070,676—Sanford (1978)
U.S. Pat. No. 4,131,894—Schiavone (1978)
U.S. Pat. No Re. 29,911—Munson (1979)
U.S. Pat. No. 4,180,817—Sanford (1979)
U.S. Pat. No. 4,220,956—Sanford (1980)
U.S. Pat. No. 4,233,607—Sanford et al (1980)
U.S. Pat. No. 4,259,670—Schiavone (1981)
U.S. Pat. No. 4,320,401—Schiavone (1982)
U.S. Pat. No. 4,079,268—Fletcher et al (1978)
U.S. Pat. No. 4,287,518—Ellis, Jr. (1981)

As those in the art will appreciate, the above list is by no means exhaustive.

As a general concept, reflectarray structures utilizing other types of elementary antenna elements are also well known in the art. For example, reference may be had to:

1. M. I. Skolnik, "Introduction to Radar Systems", McGraw-Hill, 1980, pages 308–309;
2. M. I. Skolnik, "Radar Handbook", Chapter 11, *Array Antennas* by Theodore C. Cheston and Joe Frank, McGraw-Hill, 1970, pages 11–54 through 11–60;
3. G. T. Ruck, D. E. Barrick, W. D. Stuart and C. K. Krichbaum, "Radar Cross-Section Handbook", Volumes 1 and 2, Plenum Press, New York, 1970, pages 585–670; and
4. H. Jasik, "Antenna Engineering Handbook", Chapter 13, by W. C. Jakes and S. D. Robertson, McGraw-Hill, 1961, pages 13–1 through 13–14.

General theoretical considerations on enhancing and reducing radar cross-sections are also found in "Method of Radar Cross-Section Analysis" by J. W. Crispin and Km. Siegel, Academic Press, 1968.

In spite of such general knowledge in the prior art of microstrip antenna elements and arrays per se and of reflectarrays using other types of antenna elements, so far as we are aware, before our invention no one has utilized a reflectarray formed of microstrip antenna radiator elements. However, as explained more fully below, we have now discovered many quite advantageous potential uses for such a microstrip species of reflectarray which uses promise to make the microstrip reflectarray a very welcome practical solution to several long-standing technical and/or commercial problems in the relevant art.

For example, microstrip reflectarrays may offer substantial commercial advantages when applied to satellite communication problems. Heretofore, the most common antenna system for receiving r.f. fields from an earth satellite station typically comprised a large parabolic-shaped dish reflector having a primary r.f. receiver (e.g., a waveguide horn) at the focal point of the shaped reflector dish. Such a dish is not only relatively expensive to form, it is relatively heavy and bulky and difficult if not impossible to visually camouflage for aesthetic or other reasons. It is also quite vulnerable to several adverse environmental parameters (e.g., wind, temperature, etc.).

Attempts to design microstrip antenna arrays for satellite communication applications using the conventional corporate, series or other intricate feedline structures to feed the individual microstrip radiator elements with respect to a common input/output port often become impractical where large arrays are concerned due to the relatively large losses involved in the lengthy microstrip feedlines at the relatively high frequencies involved. However, we have now discovered that these problems can be overcome by designing the microstrip antenna array structure as a "reflectarray" such that the antenna array acts as a passive-shaped reflector directing incident r.f. energy toward a feed system focal area or spot where a waveguide horn or the like is located.

The antenna array itself thus remains effective as a very efficient collector of incident microwave r.f. electromagnetic energy. (i.e., losses otherwise involved in the conventional feedline structure associated with the microstrip array are avoided.) In addition, many of the problems associated with prior art parabolic-shaped metallic dish reflectors (e.g., mechanical stability, wind loading, etc.) are simultaneously alleviated by using the microstrip reflectarray which can be simply affixed (e.g., with adhesives, nails, screws, or any other conventional technique of affixation) to a flat (or other shape) wall on the south side of a building for satellite television reception or the like (assuming that the earth satellite station of interest is located in a geo-stationary orbit in the southern sky—as is currently the case for many applications).

At the same time, the microstrip reflectarray structure will retain all of the usual advantages associated with microstrip antenna structures (e.g., they may be made so as to be conformable to other than flat surfaces, easily retrofitted so as to replace other types of antenna structures, simply fabricated using photo-chemical processes with relatively inexpensive materials so as to produce a monolithic structure capable of withstanding relatively high static and/or dynamic mechanical loads, temperatures, etc.). 10 In the presently preferred exemplary embodiment, the monolithic low profile microstrip phased reflectarray of this invention utilizes microstrip radiating elements having half-wavelength resonant dimensions. Each microstrip radiator element is individually "phased" by connection to a specified phase length of microstrip line (1) to effectively cause the incident field to be steered so as to direct it to a desired position (e.g., a waveguide feedhorn or the like), or (2) to enhance the retro-reflected field (e.g., so as to enhance the radar cross-section of the object to which the reflectarray is attached or conformed) or to reduce the retro-reflected field (e.g., so as to reduce the radar cross-section of the object to which the reflectarray is attached or conformed). The phasing microstrip transmission lines are individually terminated (e.g., an open circuit, a short circuit, a particular type of inductive or capacitive impedance, a resistive lossy impedance, a switchable diode connected in series with such a termination, etc.) depending upon the type of application involved.

As just mentioned, we have also discovered that this same microstrip reflectarray structure may be easily configured so as to either enhance or reduce the radar cross-section of the object to which it is attached or conformed. For example, if an object inherently has a relatively low radar cross-section and no large protrusion is allowed, the reflectarray can be designed and placed on the object (e.g., conformed to its natural shape) so as to enhance the amount of incident radar energy retro-reflected toward the originating radar set. Of course, the reverse of this phenomenon is also achievable where a reduction in the retro-reflected radar energy may be desired. For this latter application, the microstrip reflectarray aperture would be phased so as to re-direct or scatter the incident radar energy away from the retro-reflect direction so as to effectively reduce the radar cross-section. This latter application may also employ lossy resistive loading of the microstrip feedlines or possibly the use of a resistive dielectric substrate throughout the whole of the microstrip reflectarray structure (i.e., between the radiator patches and the underlying ground plane) so as to help absorb the incident r.f. power.

Among other advantages, for a satellite antenna array application, the microstrip reflectarray structure of this invention tends to minimize feedline losses thus enhancing the effective utility of microstrip antenna arrays for satellite communication purposes while at the same time reducing costs, providing a less complicated mechanical structure and other advantages as already mentioned. Enhancement or reduction of radar cross-sections can be obtained using this same type of microstrip reflectarray. By properly phasing the array aperture, back scattered radiation energy retro-reflected from an object can be increased. Alternatively, by resistively loading the microstrip lines, incident radar power can be absorbed. By both appropriately tapering the array aperture so as to misdirect any re-transmitted energy away from the retro-reflection direction and/or by resistively loading the array structure, the incident radar energy can be both re-directed and partially absorbed so as to even better minimize the radar cross-section.

In the exemplary embodiments, the microstrip reflectarray uses halfwave resonant rectangular microstrip patches located on a dielectric substrate with a conducting ground plane. Each element is attached to a microstrip transmission line or to a feedthrough pin to a transmission line. The transmission lines are used to phase the array so as to direct any re-transmitted field in a preferred direction.

These as well other objects and advantages of this invention will be better understood and appreciated by a careful reading of the following detailed description of the presently preferred exemplary embodiments of this invention in conjunction with the accompanying drawings, of which:

FIGS. 8, 9 and 10 depict various circularly polarized and/or elliptically polarized microstrip reflectarray embodiments in accordance with this invention;

Figure 12:
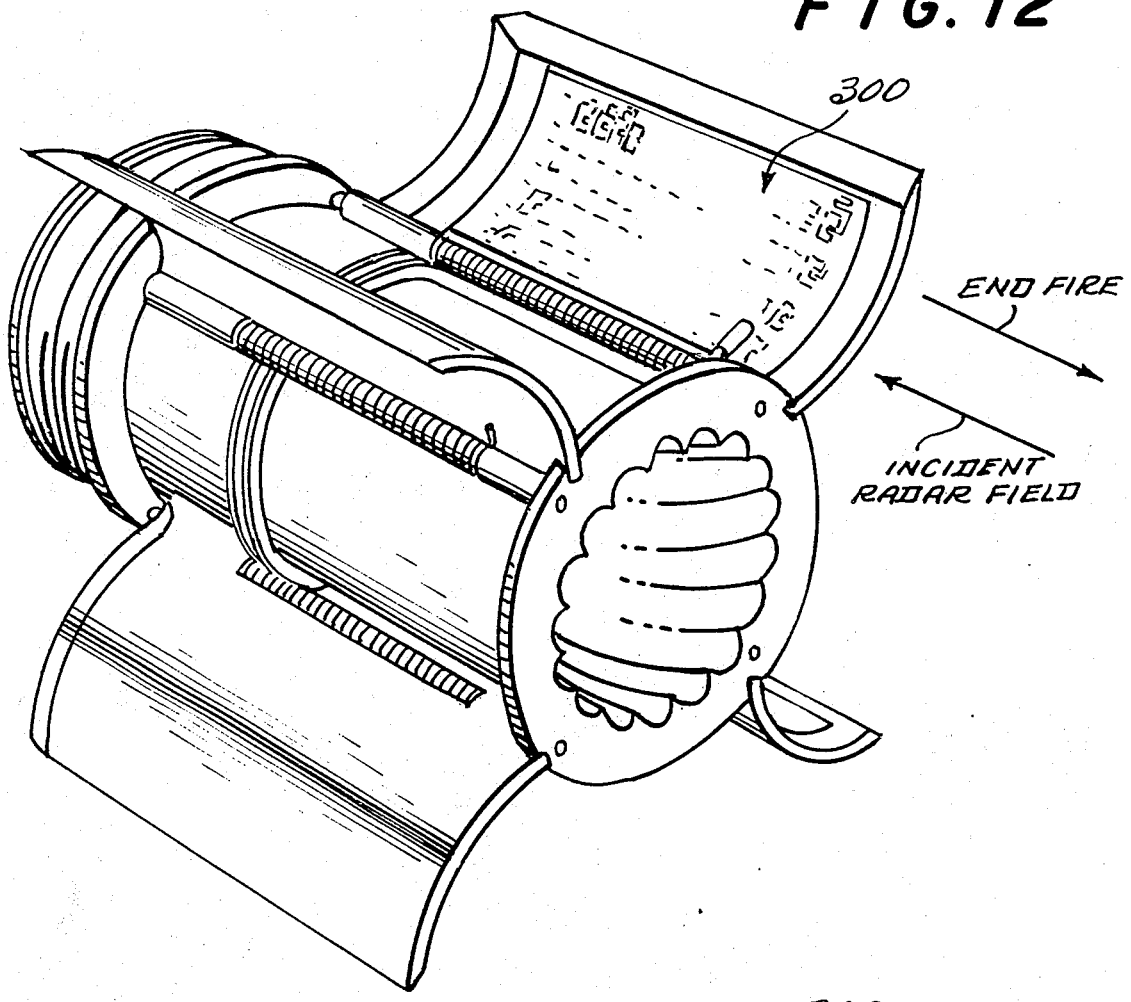
Figure 13:
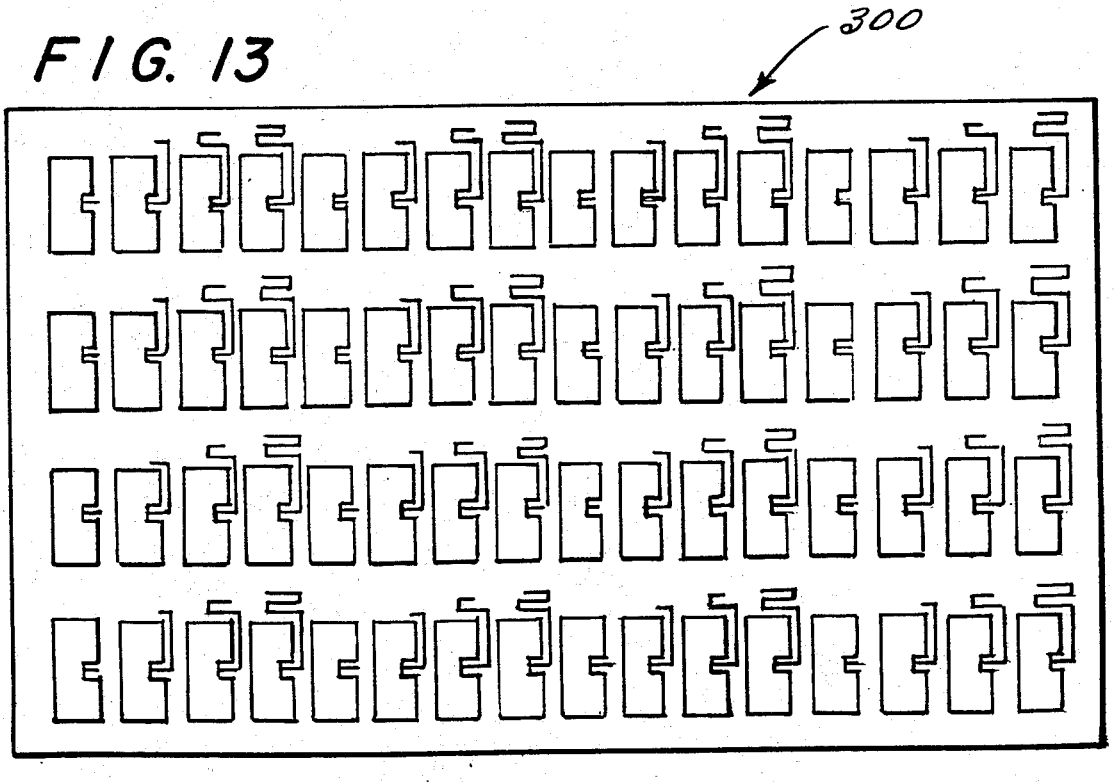

FIG. 12 generally depicts a projectile casing having spring-loaded cylinder segments which open in flight to expose microstrip reflectarray antennas designed in accordance with this invention so as to have "end fire" re-direction capabilities thus enhancing the radar cross-section of the projectile as it is viewed by a radar set directed to strike the rear of the moving projectile; and FIG. 13 is an expanded view of one of the microstrip reflectarrays used in FIG. 12.

Figure 1:
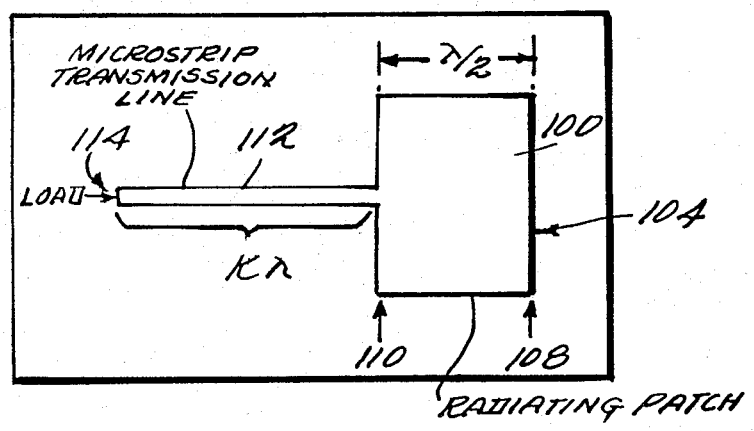
FIGS. 1 and 2 are a plan and perspective view respectively of a single microstrip radiating patch and its associated terminated transmission line segment of the type that may be replicated and arrayed in a microstrip reflectarray in accordance with this invention.
Figure 2:
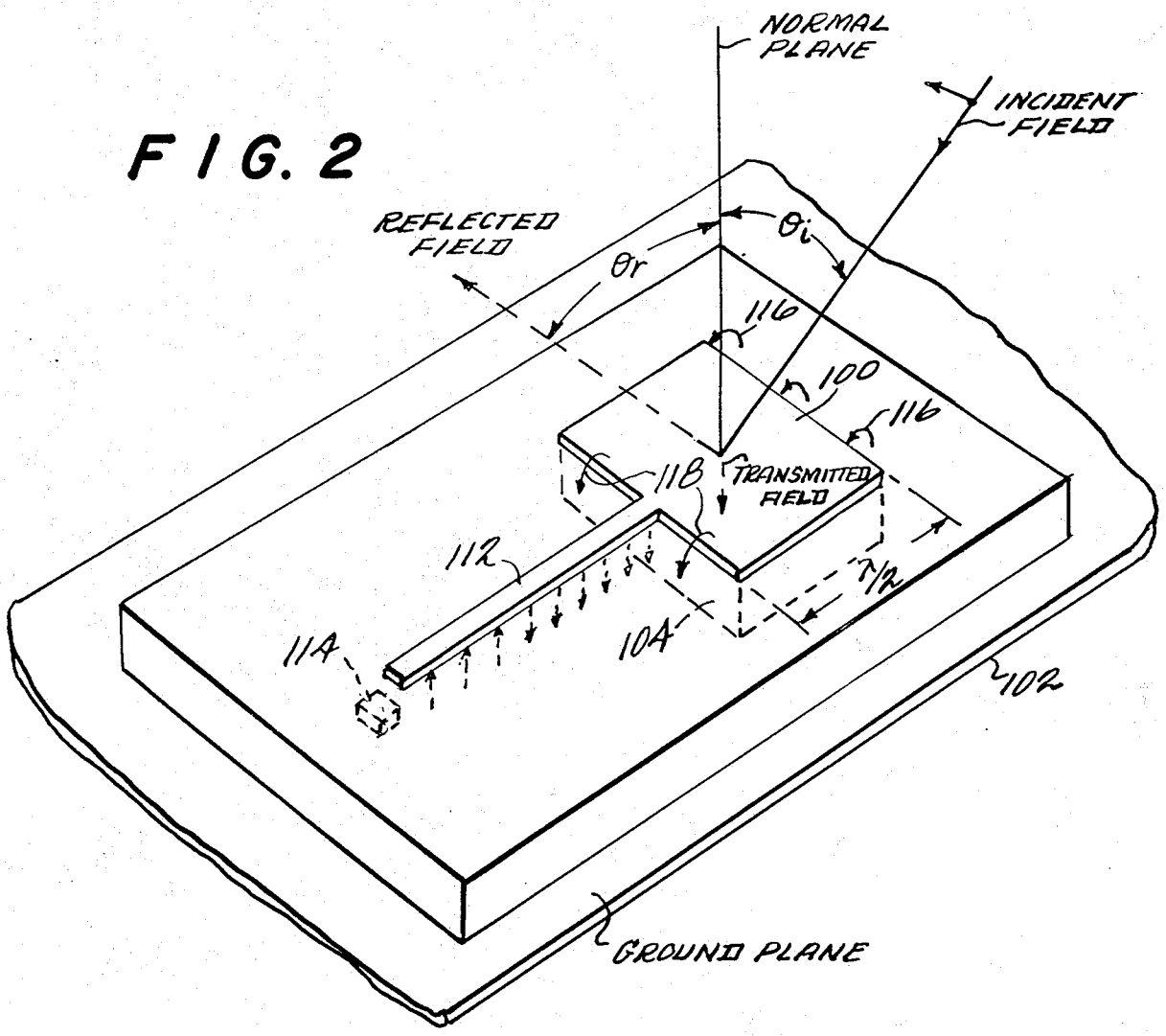

A typical microstrip antenna element is depicted in FIGS. 1 and 2. It includes a resonantly dimensioned radiating patch 100 (a very thin essentially two-dimensional electrically conductive area) closely spaced above an electrically conducting ground plane or reference surface 102 (typically spaced less than one-tenth of a wavelength at the intended antenna operating frequency above the ground plane). In the exemplary embodiment of FIGS. 1 and 2, the radiating patch 100 has a resonant dimension of one-half wavelength thus defining a one-half wavelength resonant cavity 104 between the radiating patch and the ground plane surface 102. In this exemplary embodiment, opposite transverse edges 104, 106 define radiating slots 108, 110 with the underlying ground plane surface. The non-resonant transverse dimension is typically substantially in excess of one-half wavelength but less than a complete wavelength. If the transverse dimension approaches one wavelength or more at the intended antenna operating frequency, then plural feedpoints are preferably utilized (e.g., at least one for every wavelength of transverse dimension) as those in the art will appreciate.

Such microstrip antenna elements of various shapes (e.g., rectangular, square, circular, elliptical and various other shapes including quarter-wavelength resonant dimensions where one side of the resonant cavity is effectively r.f. shorted to the underlying ground plane by pins or other means) are well known in the art. Typically, a relatively thin dielectric layer (e.g., Teflon, fiberglass of 1/32 inch thickness) is copper cladded on both sides (e.g., 0.001 inch thick copper coating) as a starting material One copper cladded side of the dielectric sheet is typically left intact as the ground or reference surface 102 while the other is selectively etched (e.g., by conventional photo-chemical etching processes similar to those used for the formation of printed circuit boards and the like) to leave one or more resonantly dimensioned radiating patches 100. In addition, it is currently typical practice to simultaneously and integrally form connected microstrip transmission feedlines for feeding r.f. energy to/from the resonantly dimensioned radiating patches. The feedlines are typically provided as a corporate structured or other series/parallel network such that all patches included in a given antenna array are fed by a common r.f. input/output port. Alternatively, it is also conventional practice to feed the individual microstrip antenna elements by connecting (e.g., soldering or the like) a feedthrough pin (e.g., the center conductor of a coaxial cable) extending through the dielectric substrate and to a feedpoint within the radiating patch that provides a matched impedance feed.

The presently preferred exemplary embodiment utilizes integrally formed and connected microstrip transmission lines 112 coupled to impedance matched feedpoints of respectively associated microstrip patches 100. The individual feedline 112 is terminated at 114 and typically has a length equal to some fraction K of a complete wavelength. Incident r.f. radiation fields 116 are then coupled to the microstrip patch 100 and resonant cavity 104 via the radiating slots 108, 110 and converted to corresponding r.f. electrical currents which propagate along the microstrip transmission line 112 toward termination 114.

If it is desired to absorb all, some or most of the incident r.f. fields, then the termination 114 will typically include lossy resistive components or materials so as to dissipate the r.f. electrical currents (i.e., as heat). On the other hand, if it is desired to re-transmit (i.e., re-direct the incident r.f. energy, then the termination 114 will typically be reactive (i.e., so as to produce a desired additional incremental phase shift or the like) or an open circuit or a short circuit condition. When these types of terminations are encountered by the propagating r.f. electrical currents, the currents are reflected along the transmission 112 and re-radiated from the radiating slots 108, 110 assocciated with the resonantly dimensioned microstrip patch 100 and resonant cavity 104. As should be appreciated, the fractional wavelength length of the microstrip transmission line 112 is effectively doubled since the r.f. electrical currents traverse this transmission line segment twice if they are reflected from the termination 114. The resulting phase shift thus encountered before the r.f. energy is re-transmitted is a function both of the transmission length and of the type of termination 114.

If the incident r.f. field 116 is assumed to be a plane wave directed at an angle $\theta_i$ with respect to a normal line to the patch 100 (as depicted in FIG. 2), then some portion of the incident field will naturally be reflected at an equal $\theta_r$ in accordance with Snell's law. In addition, some portion of the field will be transmitted into, i.e., coupled to the cavity 104 (typically a dielectric structure as earlier mentioned) via the radiating slots. In addition, where transmission line 112 has been terminated so as to cause substantial reflection of r.f. electrical currents, there will be re-transmitted fields (depicted at 116, 118 in FIG. 2) emanating from the radiating slots 108, 110. By properly arraying microstrip antenna elements and their associated individually terminated transmission line segments, and by appropriately controlling the phase of each individual antenna element in the array across the aperture of the array, the re-transmitted field may be caused to be re-directed at a predetermined angle $\theta_d$ as indicated in FIGS. 3–5 which depict such a microstrip reflectarray.

Thus, FIGS. 1 and 2 show the physical phenomenon of a single half-wave microstrip reflecting patch. The reflecting element is resonated through an incident plane wave field which is somewhat different than the standard microstrip antenna excitation using a coaxial feed section from ground plane side or through edge launching into a microstrip transmission line. The incident field partially is coupled into the microstrip resonant element, the remainder is reflected and/or transmitted into the dielectric substrate. The field coupled into the microstrip element propagates into the transmission line with certain type of end load. A reflection of the signal will be encountered depending on the load condition. Generally, a two-way phase shift is expected through the transmission line. The choice of phase shift determines the re-directed radiation characteristic of the reflectarray. A matched load at the end of each transmission line will absorb the coupled field. A short or an open load will reflect the field with a two-way phase shift. The selection of these transmission lines and end loads will depend on the type of application (satellite antennas, radar antennas, radar cross-section enchance or reduction).

Figure 3:
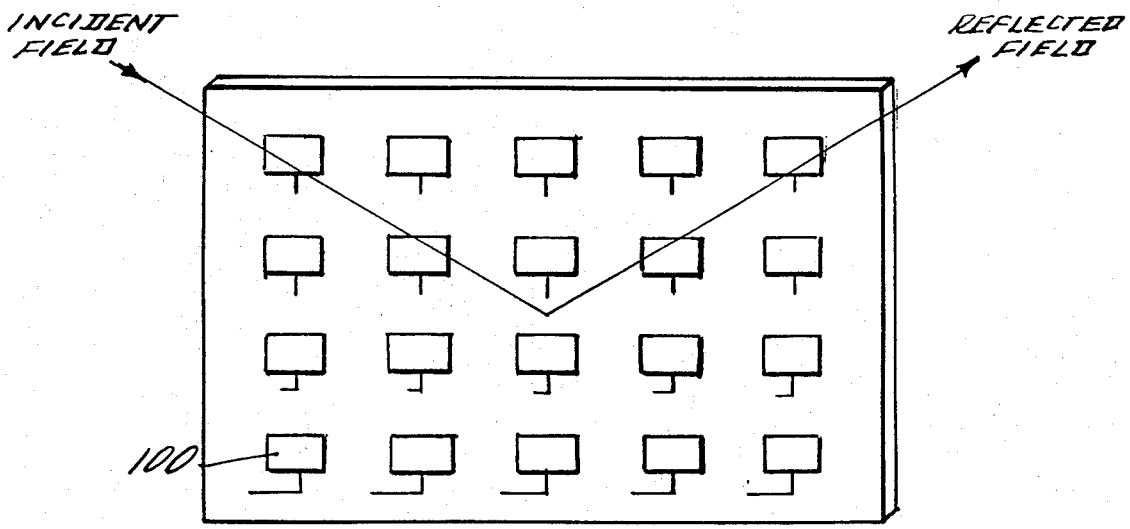
FIG. 3 is a plan view of an arbitrary exemplary microstrip reflectarray constructed in accordance with this invention using the microstrip patch/line elements of FIGS. 1 and 2.
Figure 4:
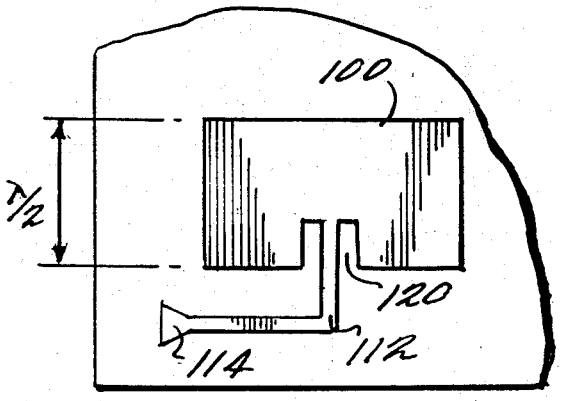
FIG. 4 is an enlarged view of one of the array elements and its associated terminated transmission line as specifically configured in the array of FIG. 3.
Figure 5:
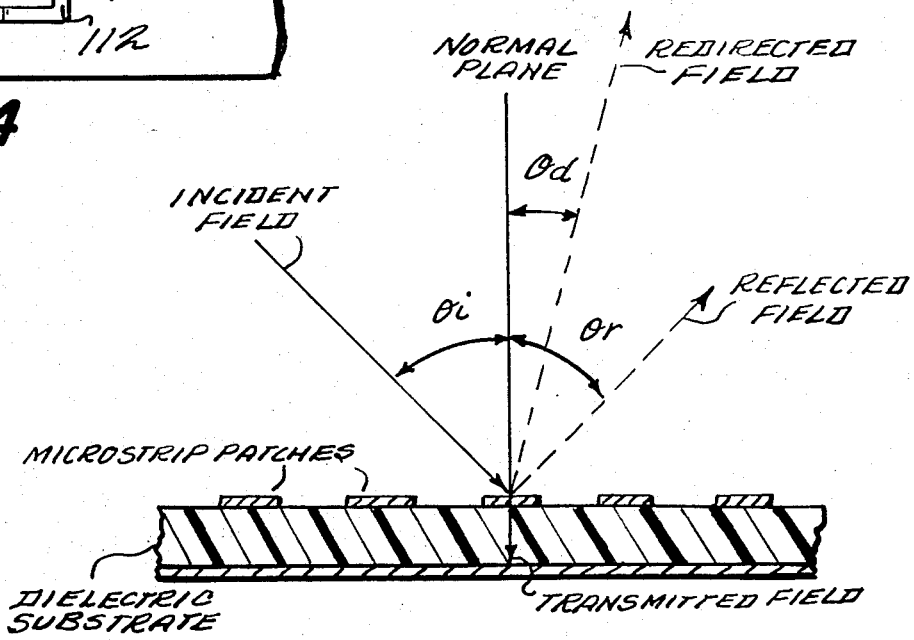
FIG. 5 is a schematic cross-sectional depiction of the array shown in FIG. 3 together with vectors representing incident, reflected, re-directed and transmitted r.f. fields.

In FIGS. 3–5, A 4×5 element microstrip reflectarray is indicated. It will be noted that the length of the transmission line segments is different for each of the four horizontal rows of elements. The showing in FIG. 3 is arbitrary and solely for the purpose of indicating that any desired two-dimensional phase taper across the two-dimensional aperture of the array may be achieved in accordance with conventional design of phase tapered array apertures. For spacing purposes, the transmission line segments may be meandered so as to fit within the available space as should be apparent to those in the art, especially in view of FIG. 3.

As indicated in FIG. 4, it is conventional practice to provide a notch 120 or the like at the feedpoint of each antenna element so as to match the impedance of the radiator element feedpoint to that of the transmission line 112. The transmission line termination (e.g., open circuit, short circuit, resistive or reactive loads as may be desired for any given application) is schematically depicted by a truncated triangle in FIG. 4.

The cross-sectional schematic depiction of FIG. 5 is similar to that of FIG. 2 except that in the context of the FIG. 3 reflectarray, there is now shown a vector representing the re-directed r.f. field at an arbitrary angle $\theta_d$ from the normal line. As should be appreciated by those in the art, conventional antenna array design techniques may be utilized for defining the required phase taper of the array aperture to achieve a desired $\theta_d$ given a known incident field orientation and thus a known incident phase taper across the aperture.

Figure 11:
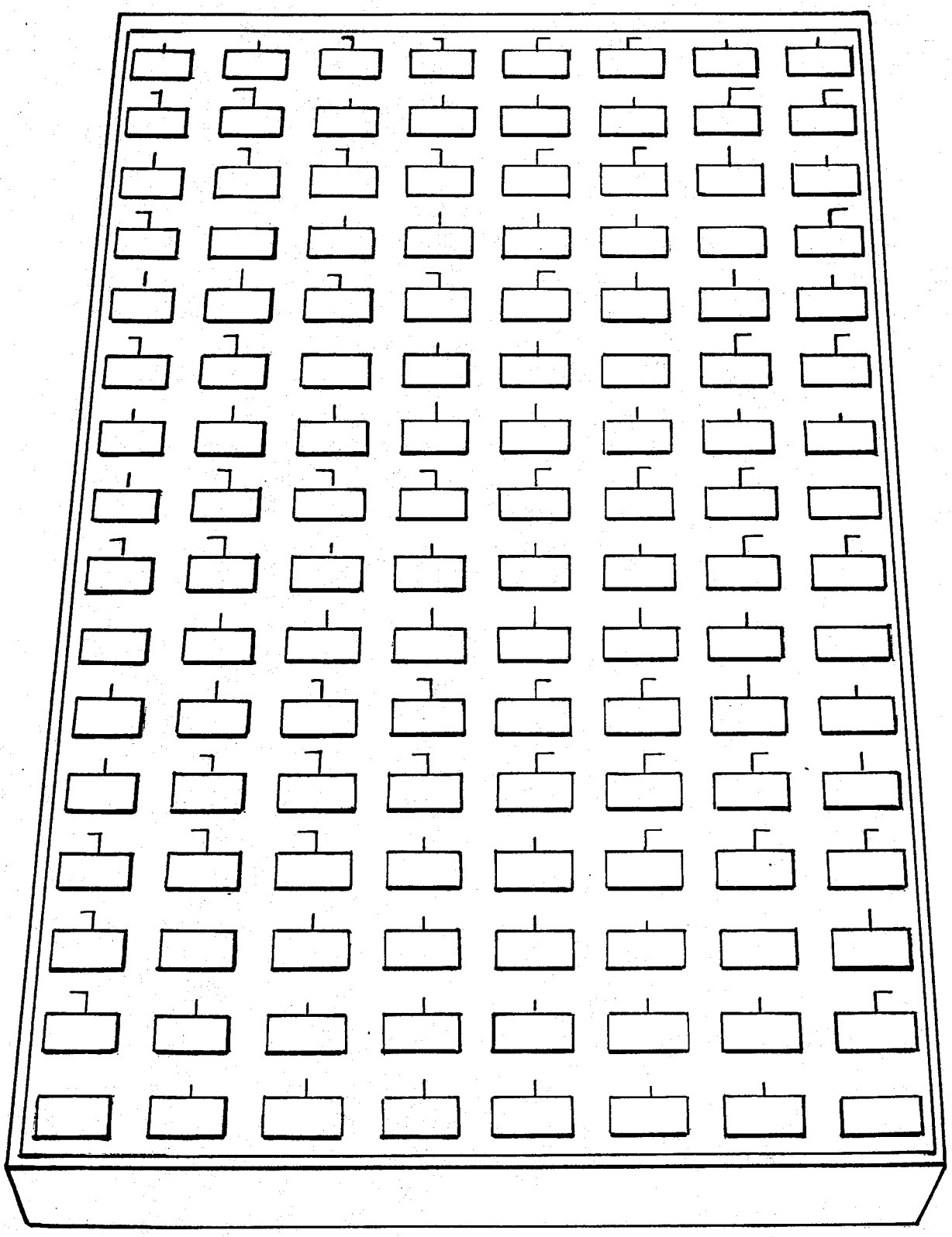
FIG. 11 is a more detailed showing of an exemplary microstrip reflectarray for use in a ground satellite communication system of the type shown in FIG. 6 where one dimension of the array aperture has been given a parabolic phase taper.

A flat reflectarray 200 depicted in FIG. 2 and in more detail at FIG. 11 may be associated with a receiver/-transmitter microwave horn structure 202 to form part of an earth satellite communication system. Although the present exemplary embodiment will be described with respect to a receiving station, those skilled in the art will appreciate that the same techniques could be used for transmission as well.

Figure 6:
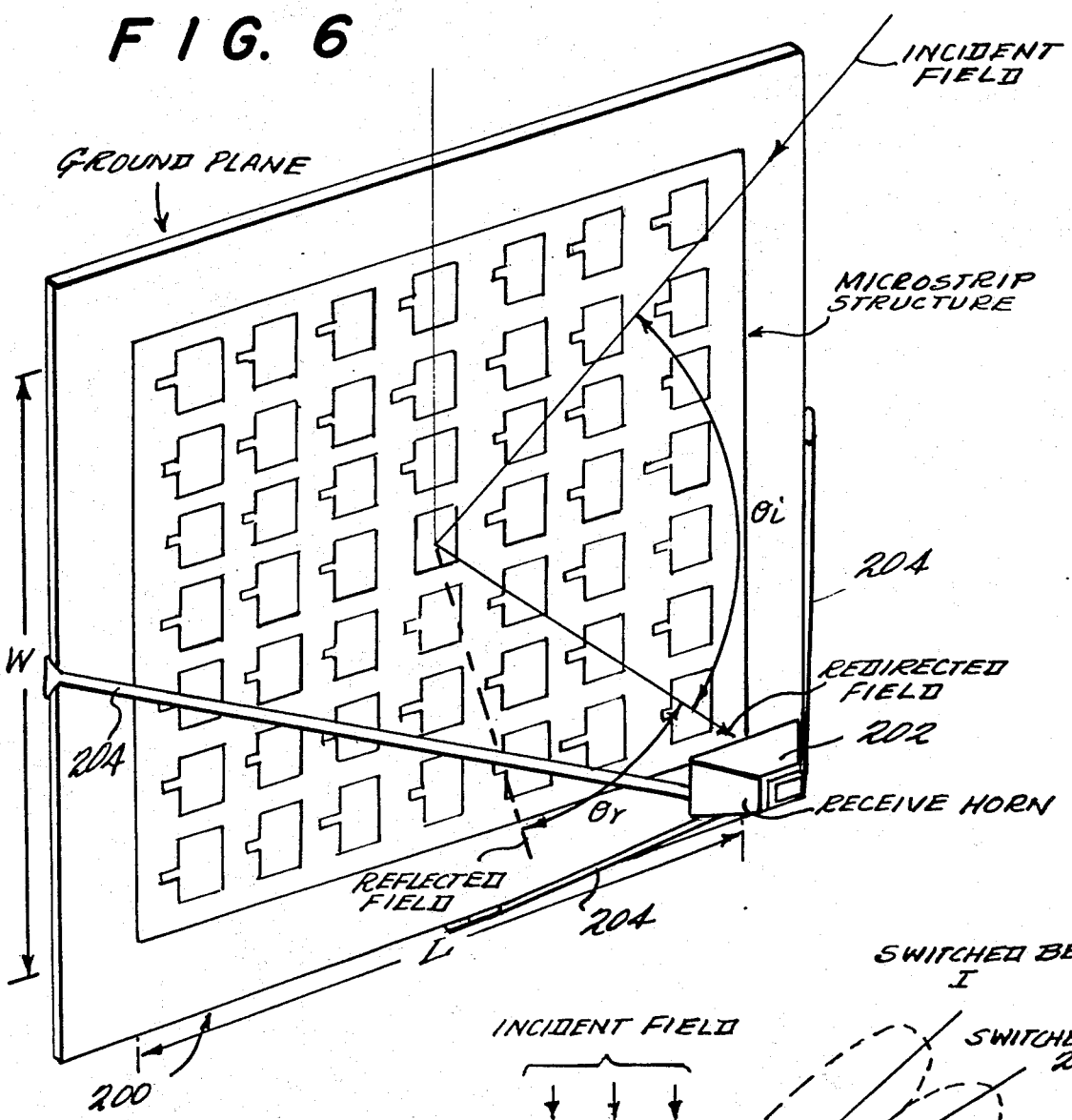
FIG. 6 is a perspective view of an antenna system for receiving/transmitting r.f. electromagnetic radiation from/to an earth satellite sation which includes a microstrip reflectarray in accordance with this invention and as depicted in FIGS. 1–5 having a parabolic phase taper across at least one dimension of the array aperture so as to re-direct r.f. radiation to/from a microwave horn structure.

The reflectarray 200 in this exemplary embodiment has been provided with a one-dimensional parabolic phase taper across its two-dimensional aperture. Accordingly, as will be observed by reference to the more detailed FIG. 11, there is but a single plane of symmetry passing mid-way between the eight vertical columns of individual antenna elements (i.e., symmetry vis-a-vis the relative phasing of individual antenna elements as can be observed by the relative lengths of terminated transmission line connected to each element). This particular phase taper has been designed (using conventional microstrip array design techniques) so as to re-direct an incident planewave of electromagnetic r.f. radiation (in the C-band at approximately 3.9 GHz) from a typical geostationary satellite as viewed in the vicinity of Boulder, Colo. With this particular planewave incident at an angle $\theta_i$ (as indicated in FIG. 6) a re-directed field will be produced normal to the flat reflectarray 200 thus intercepting the receive horn 202 which is affixed (e.g., via support structures 204) so as to intercept the re-directed field). There will, of course, also be some reflected field at the Snell angle as will be appreciated by those in the art. However, the microstrip reflectarray and receiver horn satellite communication system of FIGS. 6 and 11 has been found to perform effectively as an efficient collector of incident r.f. radiation.

The exemplary microstrip reflectarray embodiment depicted in FIG. 11 has been successfully tested using the following design criteria:

(a) overall array aperture=16×8 elements, 33″×22″
(b) radiator element dimensions=1.8″×0.925″
(c) interelement spacing=1.9″ center-to-center transverse to longer rectangle dimension 2.6″ center-to-center transverse to shorter rectangle dimension
(d) microstrip transmission line width=0.02″
(e) frequency=3.9 GHz
(f) $\lambda_o$=2.99″
(g) $\theta_i$=60°
(h) transmission line lengths $$1 = \frac{\phi}{333.54}$$

where $\theta$ is desired relative phase shift in degrees:

| | $\phi$ values in degrees | | | |
|---|---|---|---|---|
| | column | | | |
| row | 1 | 2 | 3 | 4 |
| 1. | 6.48 | 72.78 | 117.54 | 140.1 |

-continued

| | $\phi$ values in degrees | | | |
|---|---|---|---|---|
| | column | | | |
| row | 1 | 2 | 3 | 4 |
| 2. | 334.94 | 42.52 | 88.16 | 111.17 |
| 3. | 292.84 | 1.57 | 48.01 | 71.43 |
| 4. | 239.65 | 309.38 | 356.53 | 20.2 |
| 5. | 174.87 | 245.44 | 293.17 | 317.24 |
| 6. | 98.1 | 169.32 | 217.5 | 241.8 |
| 7. | 9.01 | 80.67 | 129.15 | 153.61 |
| 8. | 267.37 | 339.25 | 27.89 | 52.43 |
| 9. | 153.05 | 224.94 | 273.58 | 298.12 |
| 10. | 26.08 | 97.74 | 146.22 | 170.69 |
| 11. | 246.56 | 317.77 | 5.95 | 30.26 |
| 12. | 94.71 | 165.28 | 213.01 | 237.08 |
| 13. | 290.87 | 0.6 | 47.74 | 71.52 |
| 14. | 115.44 | 184.17 | 230.61 | 254.03 |
| 15. | 288.92 | 356.5 | 42.14 | 65.15 |
| 16. | 91.84 | 158.14 | 202.91 | 225.46 |

col 5 = col 4
col 6 = col 3
col 7 = col 2
col 8 = col 1

Although the exemplary embodiment of FIGS. 6 and 11 was only constructed and tested using a one-dimensional parabolic phase taper across one axis or dimension of the array aperture (i.e., from side to side in FIG. 11), it should be appreciated that even greater efficiency can be expected by providing a two-dimensional parabolic phase taper with a more concentrated focal spot or area (or other desired phase tapers that effectively result in concentrating re-directed energy from the reflectarray to a common receive/transmit feedpoint such the horn 202 in FIG. 5) could be achieved.

Figure 7:
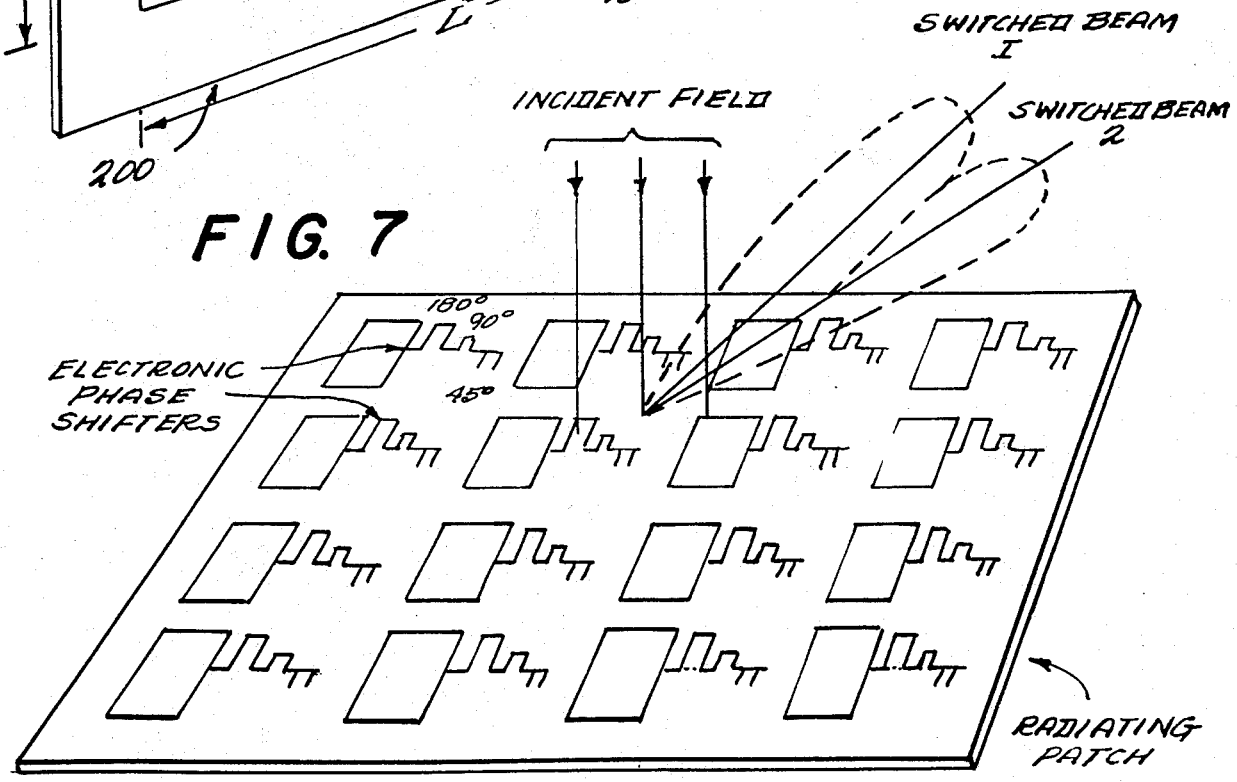
FIG. 7 is an alternative microstrip reflectarray in accordance with this invention including electronically controlled phase shifters so as to permit the re-directed r.f. radiation to be switched between different beam positions.

The microstrip reflectarray of this invention may also be electronically controlled as depicted in FIG. 7. Here, for example, each of the individual microstrip antenna elements has a series of electronically switchable phase shifters connected in its individually associated transmission line structure. In this exemplary embodiment, a conventional three-bit electronic phase shifter is employed such that any desired combination of 180° and-/or 90° and/or 45° relative phase shift can be attained by appropriately controlling diode switches in the transmission line structure. By employing such conventional beam steering techniques, those in the art will appreciate that it should be possible to steer the re-directed beam of the microstrip reflectarray in any desired manner—e.g., randomly if desired to scatter an incoming field.

It should also be appreciated that the microstrip reflectarray of this invention need not be limited to linearly polarized individual array elements. In particular, circularly and/or elliptically polarized microstrip antenna elements may be employed as depicted in FIGS. 8, 9 and 10. Since all of these microstrip antenna elements are per se well known in the art, only a very brief description need be given here.

In the embodiment of FIG. 8, the microstrip radiator patches are substantially square-shaped but have feedpoints on adjacent sides that are phased relative to one another by 90°. The 90° phase shifter feed network is schematically depicted in FIG. 8. Also depicted are various length terminated transmission line segments connected, in turn, to the feedpoint of the 90° phase shifter circuit.

In FIG. 9, one dimension of the almost square microstrip patches is altered slightly so as to cause the r.f.

impedance along orthogonal axes to be approximately complex conjugates of each other or other desired relationships. Circular and/or elliptical polarization can then be had by merely feeding each patch near a corner point as indicated in FIG. 9. As also indicated in FIG. 9, the feedpoints are connected to individually terminated transmission line segments which have lengths chosen so as to achieve a desired phase taper across the array aperture.

Another exemplary circular or elliptical polarization embodiment of the microstrip reflectarray is depicted at FIG. 10 where substantially circular microstrip patches are fed at two different points separated by 90° and fed by signals having 90° relative phase different. The 90° relative phase differences can, for example, be provided by 90° hybrid transmission line circuits provided on a second layered hybrid board with pin connectors extending through to the feedpoints of the circular patches, etc., in accordance with conventional practice.

As will be appreciated, it is common practice to connect such transmission lines to an impedance-matched feedpoint.

FIG. 12 depicts a portion of a cylindrical projectile having spring-loaded cylindrical segments that automatically extend during flight to expose microstrip reflectarrays constructed in accordance with this invention. In the exemplary application, it is desired to enhance the radar cross-section of the projectile so that it can be accurately tracked by a radar set located at approximately the launch site of the projectile. Under such circumstances, the incident radar field will be approximately directed toward the rear of the projectile as depicted in FIG. 12. The microstrip reflectarray 300 (a 4×16 element array in this exemplary embodiment) is then provided with a one-dimensional phase taper (i.e., across the long dimension of the array aperture with relative phasing of 0°, 90°, 180°, 270°, 0°, etc.) so as to produce an "end fire" radiation pattern for the redirected energy. In this particular circumstance, the end fire radiation pattern of the microstrip reflectarray 300 causes an essentially retro-reflection of the incident radar field. Substantial enhancement of the radar cross-section results. The exemplary microstrip reflectarray 300 is shown in more detail at FIG. 13.

Using conventional microstrip antenna array design techniques, the incident field may also be caused to be steered in a direction other than the retro-reflection direction and/or to be randomly scattered (i.e., by properly controlling an electronically steered microstrip reflectarray). Alternatively, and/or in addition thereto, to reduce the radar cross-section, the incident field may be absorbed by resistive loads at the transmission line terminations and/or distributed resistive loads throughout the dielectric substrate.

Although only a few exemplary embodiments of this invention have been described in detail above, those skilled in the art will recognized that there are many possible variations and modifications that may be made in these exemplary embodiments without materially departing from many of the novel advantages and features of this invention. Accordingly, it is intended that all such variations and modifications be included within the scope of the following appended claims.

What is claimed is:

1. A reflectarray of passive microstrip antenna radiators comprising:

an electriclally conducted reference surface;

an array of resonantly-dimensioned electrically conducting passive microstrip antenna radiator elements spaced less than one-tenth wavelength at the intended antenna operating frequency above said reference surface;

each of said radiator elements defining a resonant cavity between it and the underlying reference surface and also defining at least one radiation slot between at least one edge of the radiator element and the underlying reference surface, said slot coupling r.f. energy to/from said element and the resonant cavity at the intended antenna operating frequency; and a plurality of individual phase-controlling passive transmission line means, each being coupled to a respective individual one of said radiator elements and having predetermined respective length and terminating impedance of a short or open circuit so as to cause the overall array to receive an incident r.f. electromagnetic field, to convert the received field into r.f. electrical currents which flow along said transmission line means and to re-transmit in a predetermined direction a re-directed r.f. electromagnetic field in response to substantially complete reflection of r.f. electrical currents from the terminations of said transmission line means.

2. A reflectarray of microstrip antenna radiators as in claim 2 wherein:

said array of radiator elements is spaced and physically supported above said reference surface by a layer of dielectric material having said reference surface cladded to one side thereof;

said radiator elements and their respectively associated transmission line means are integrally formed from a common metallic layer cladded to the other side of said dielectric material layer by selective removal thereof so as to form individual integrally connected radiator elements and associated microstrip transmission line segments, each radiator element and its connected transmission line segment being electrically isolated from the others;

said dielectric layer and its cladded metallic surfaces being sufficiently flexible to be conformable to shaped non-planar surfaces.

3. A reflectarray of microstrip antenna radiators as in claim 1 or 2 wherein said terminating impedances include open circuits.

4. A reflectarray of microstrip antenna radiators as in claim 1 or 2 wherein said terminating impedances include short circuits.

5. A reflectarray of microstrip antenna radiators as in claim 1 or 2 wherein said terminating impedances include electrically controllable elements which present an r.f. termination short or open circuit impedance that can be changed by application of a controlling electrical signal thereto.

6. A reflectarray of microstrip antenna radiators as in claim 5 wherein said electrically controllable impedance elements comprise switchable diodes.

7. A reflectarrary of microstrip antenna radiators as in claim 1 or 2 wherein said re-directed r.f. electromagnetic field is retro-reflected in a direction back towards the origin of the incident r.f. electromagnetic field.

8. A reflectarray of microstrip antenna radiators as in claim 1 or 2 wherein said re-directed r.f. electromagnetic field is directed so as to substantially avoid the origin of the incident r.f. electromagnetic field.

9. A reflectarray of microstrip antenna radiators as in claim 1 or 2 further comprising a primary receiving antenna structure disposed at a predetermined location with respect to said array of radiator elements and wherein said re-directed r.f. electromagnetic field is directed towards said primary receiving antenna structure.

10. A reflectarray of microstrip antenna radiators as in claim 9 wherein said primary receiving antenna structure comprises a microwave horn.

11. A reflectarray of microstrip antenna radiators as in claim 1 or 2 further comprising a primary transmitting antenna structure disposed at a predetermined location with respect to said array of radiator elements and wherein an r.f. electromagnetic field from said primary transmitting antenna structure incident upon said array is re-transmitted towards a predetermined receiving site.

12. A reflectarray of microstrip antenna radiators as in claim 1 or 2 wherein each of said microstrip antenna radiator elements includes a two-dimensional surface and wherein at least one dimension thereof is substantially equal to one-half wavelength at the intended antenna operating frequency.

13. A reflectarray of microstrip antenna radiators as in claim 12 wherein the other dimension of said two-dimensional surface is substantially greater than one-half wavelength at the intended antenna operating frequency.

14. A reflectarray of microstrip antenna radiators as in claim 1 or 2 wherein said individual phase-controlling transmission line means includes a phase shifter.

15. A reflectarray of microstrip antenna radiators as in claim 1 or 2 wherein said radiator elements are dimensioned so as to receive/transmit circularly or elliptically polarized r.f. electromagnetic radiation.

16. A reflectarray of microstrip antenna radiators as in claim 15 wherein said individual phase-controlling transmission line means includes a phase shifter designed to provide/accept two electrical signals having a 90° relative phase difference at the intended antenna operating frequency.

17. An antenna system for receiving r.f. electromagnetic radiation from an earth satellite station, said antenna system comprising:

a passive reflectarray of microstrip antenna radiator patches spaced above an electrical reference surface by less than one-tenth wavelength;

said patches having at least one resonant dimension substantially equal to one-half wavelength at the intended antenna operating frequency and having respective individually short or open circuit terminated microstrip transmission lines integrally connected therewith and differently dimensioned across the array aperture so as to reflect and re-direct r.f. electromagnetic radiation incident upon the array towards a predetermined direction; and a primary r.f. electromagnetic radiation receiving structure fixedly disposed with respect to said reflectarray so as to intercept said re-directed radiation.

18. An antenna system as in claim 17 wherein said passive reflectarray is approximately planar and suited for affixation to a wall structure generally directed toward the earth satellite station.

19. An antenna system as in claim 17 or 18 wherein said primary r.f. electromagnetic radiation receiving structure comprises a microwave gude horn structure.

20. An antenna system as in claim 17 or 18 wherein said terminated transmission lines are dimensioned relative to one another so as to provide a parabolic phase taper across the at least one dimension of the aperture of the arrayed radiator patches.

21. An array of microstrip antenna radiators for reducing the radar cross-section of an object to which it is affixed, said array comprising:

an electrically conducting reference surface;

an array of resonantly-dimensioned electrically conducting passive microstrip antennna radiator elements spaced less than one-tenth wavelength at the intended antenna operating frequency above said reference surface;

each of said passive radiator elements defining a resonant cavity between it and the underlying reference surface and also defining at least one radiation slot between at least one edge of the radiator element and the underlyiing reference surface, said slot coupling r.f. energy to/from said element and the resonant cavity at the intended antenna operating frequency; and a plurality of individual phase-controlling passive transmission line means, each being coupled to a respective individial one of said radiator elements and having predetermined respective length and terminating impedance including electrical resistance to cause the overall array to receive an incident r.f. electromagnetic field, to convert the received field into r.f. electrical currents which flow along said transmission line means and to substantially dissipate said electrical currents by passage through said resistance.

22. An array of microstrip antenna radiators as in claim 21 wherein:

said array of radiator elements is spaced and physically supported above said reference surface by a layer of dielectric material having said reference surface cladded to one side thereof;

said radiator elements and their respectively associated transmission line means are integrally formed from a common metallic layer cladded to the other side of said dielectric material layer by selective removal thereof so as to form individual integrally connected radiator elements and associated microstrip transmission line segments, each radiator element and its connected transmission line segment being electrically isolated from the others;

said dielectric layer and its cladded metallic surfaces being sufficiently flexible to be conformable to shaped non-planar surfaces.

23. An array of microstrip antenna radiators as in claim 22 wherein said dielectric material includes resistive material embedded therewithin.

24. A reflectarray of microstrip antenna radiators as in claim 21 or 22 wherein said terminating impedance electrically controllable elements which present an r.f. termination condition that can be changed by application of a controlling electrical signal thereto.

25. A reflectarray of microstrip antenna radiators as in claim 24 wherein said electrically controllable impedance elements comprise switchable diodes.

26. A reflectarray of microstrip antenna radiators as in claim 21 or 22 wherein said re-directed r.f. electromagnetic field is directed so as to substantially avoid the origin of the incident r.f. electromagnetic field.

27. A reflectarray of passive microstrip antenna radiators for enhancing the radar cross-section of an object to which it is attached, said reflectarray comprising:

an electrically conducting reference surface;

an array of resonantly-dimensioned electrically conducting passive microstrip antenna radiator elements spaced less than one-thenth wavelength at the intended antenna operating frequency above said reference surface;

each of said passive radiator elements thus defining a resonant cavity between it and the underlying reference surface and also defining at least one radiation slot between at least one edge of the radiator element and the underlying reference surface, said slot coupling r.f. energy to/from said element and the resonant cavity at the intended antenna operating frequency; and a plurality of individual phase-controlling transmission line means, each being coupled to a respective individual one of said radiator elements and having predetermined respective length and terminating open or short circuit impedance so as to cause the overall array to receive an incident r.f. electromagnetic field, to convert the received field into r.f. electrical currents which flow along said transmission line means, to reflect substantially all of said currents from said termination and to re-transmit in a predetermined direction substantially toward the source of said incident r.f. field a re-directed r.f. electromagnetic field in response to reflection of r.f. electrical currents from the terminations of said transmission line means.

28. A reflectarray of microstrip antenna radiators as in claim 27 wherein:

said array of radiator elements is spaced and physically supported above said reference surface by a layer of dielectric material having said reference surface cladded to one side thereof;

said radiator elements and their respectively associated transmission line means are integrally formed from a common metallic layer cladded to the other side of said dielectric material layer by selective removal thereof so as to form individual integrally connected radiator elements and associated microstrip transmission line segments, each radiator element and its connected transmission line segment being electrically isolated from the others;

said dielectric layer and its cladded metallic surfaces being sufficiently flexible to be conformable to shaped non-planar surfaces.

29. A reflectarray of microstrip antenna radiators as in claim 27 or 28 wherein said terminating impedances include open circuits.

30. A reflectarray of microstrip antenna radiators as in claim 27 or 28 wherein said terminating impedances include short circuits.

31. A reflectarray of microstrip antenna radiators as in claim 27 or 28 wherein each of said microstrip antenna radiator elements includes a two-dimensional surface and wherein at least one dimension thereof is substantially equal to one-half wavelength at the intended antenna operating frequency.

32. A reflectarray of microstrip antenna radiators as in claim 31 wherein the other dimension of said two-dimensional surface is substantially greater than one-half wavelength at the intended antenna operating frequency.

33. A reflectarray of microstrip antenna radiators as in claim 27 or 28 wherein said individual phase-controlling transmission line means includes a phase shifter.

34. A reflectarray of microstrip antenna radiators as in claim 27 or 28 wherein said radiator elements are dimensioned so as to receive/transmit circularly or elliptically polarized r.f. electromagnetic radiation.

35. An antenna system for transmitting r.f. electromagnetic radiation to an earth satellite station, said antenna system comprising:

a passive reflectarray of microstrip antenna radiator patches spaced above an electrical reference surface by less than one-tenth wavelength;

said patches having at least one resonant dimension substantially equal to one-half wavelength at the intended antenna operating frequency and having respective individually open or short circuit terminated microstrip transmission lines integrally connected therewith and differently dimensioned across the array aperture so as to re-direct r.f. electromagnetic radiation incident upon the array from a first predetermined direction towards a second predetermined direction; and a primary r.f. electromagnetic radiation transmitting structure fixedly disposed with respect to said reflectarray so as to direct r.f. radiation towards said reflectarray along said first predetermined direction.

36. An antenna system as in claim 35 wherein said passive reflectarray is approximately planar and suited for affixation to a wall structure generally directed toward the earth satellite station.

37. An antenna system as in claim 35 or 36 wherein said primary r.f. electromagnetic radiation transmitting structure comprises a microwave guide horn structure.

38. An antenna system as in claim 35 or 36 wherein said terminated transmission lines are dimensioned relative to one another so as to provide a parabolic phase taper across the at least one dimension of the aperture of the arrayed radiator patches.

* * * * *